US006992591B2

(12) United States Patent
Jensen et al.

(10) Patent No.: US 6,992,591 B2
(45) Date of Patent: Jan. 31, 2006

(54) MARKER LIGHTS FOR WIRELESS DOORBELL TRANSMITTERS AND OTHER DEVICES

(75) Inventors: Bradford B. Jensen, Saint Joseph, MI (US); Roger D. Bentley, Coloma, MI (US); Kim I. McCavit, Saint Joseph, MI (US)

(73) Assignee: Jenesis International Inc., Stevensville, MI (US)

( * ) Notice: Subject to any disclaimer, the term of this patent is extended or adjusted under 35 U.S.C. 154(b) by 317 days.

(21) Appl. No.: 10/077,010

(22) Filed: Feb. 15, 2002

(65) Prior Publication Data

US 2003/0169178 A1 Sep. 11, 2003

(51) Int. Cl.
*G08B 5/36* (2006.01)

(52) U.S. Cl. ..... 340/815.5; 340/815.4; 340/815.45; 340/326; 340/330; 340/332

(58) Field of Classification Search ..... 340/815.5, 340/815.53, 330, 326, 815.45, 815.4, 331, 340/332; 362/555, 559, 812, 186, 191, 195, 362/200, 240, 249; 262/186, 191, 200, 800
See application file for complete search history.

(56) References Cited

U.S. PATENT DOCUMENTS

| | | | | |
|---|---|---|---|---|
| 3,869,641 | A * | 3/1975 | Goldberg | 315/135 |
| 4,451,871 | A * | 5/1984 | Kirkley et al. | 362/186 |
| 5,313,187 | A | 5/1994 | Choi et al. | |
| 5,428,388 | A * | 6/1995 | von Bauer et al. | 348/155 |
| 5,542,201 | A * | 8/1996 | Grondal et al. | 40/570 |
| 5,584,555 | A * | 12/1996 | Larsson | 362/23 |
| 5,803,579 | A | 9/1998 | Turnbull et al. | |
| 6,003,206 | A | 12/1999 | Hall et al. | |
| 6,086,218 | A | 7/2000 | Robertson | |
| 6,137,396 | A | 10/2000 | Puppo | |
| 6,140,776 | A | 10/2000 | Rachwal | |
| 6,265,984 | B1 * | 7/2001 | Molinaroli | 340/815.4 |

FOREIGN PATENT DOCUMENTS

| | | |
|---|---|---|
| EP | 1 077 441 A | 2/2001 |
| GB | 2 205 433 A | 12/1988 |
| WO | WO 00/63730 | 10/2000 |
| WO | WO 01/01038 A | 1/2001 |

* cited by examiner

*Primary Examiner*—Hung Nguyen
(74) *Attorney, Agent, or Firm*—Paul W. O'Malley; Susan L. Firestone

(57) ABSTRACT

Battery powered LEDs operated at a small fraction of their rated capacity to provide a level of illumination useful as a marker for darkness adjusted vision. Long battery life is achieved using super bright, broad spectrum LEDs.

36 Claims, 13 Drawing Sheets

MARKER LIGHTS FOR WIRELESS DOORBELL TRANSMITTERS AND OTHER DEVICES

BACKGROUND OF THE INVENTION

1. Field of the Invention

The present invention relates to low intensity level luminaires, particularly for use marking the location of doorbell buttons, driveway edges and the like, and more particularly relating to a battery powered luminaire providing a useful battery life of one or more years.

2. Description of the Problem

Since the introduction of wireless doorbells, customers have requested a lighted button feature to assist in locating the doorbell button in the dark. Lacking connection to line electrical power, providing such a feature has proven impractical to achieve with even the smallest incandescent sources. The power demands of incandescent bulbs exhaust the capacity of typical battery sizes usable in these products within hours, or days, at best. Larger batteries could increase battery life, but these are costly and their bulk is not appropriate in the application of a doorbell button. Early, non-high intensity type, LED light sources, while operable for far longer periods than incandescent sources, still cannot operate at the very low current levels required to obtain desirable battery life objectives of one year or longer while emitting useful levels of light.

Other products could benefit from a battery powered, long life light source suitable for use in a wireless doorbell. Self-contained battery powered chimes hardwired to a door mounted push button are very common in Europe, although somewhat rare in North America. Lighted buttons are a desirable feature here as well, but cause the batteries in the chime to become quickly exhausted. Thus battery chime systems have not included a lighted button. Presently, incandescent bulbs and low efficiency LED light sources are used in lighted buttons, but they consume far too much current to provide acceptable battery life in battery powered chimes.

Battery life can be extended for an LED device by causing the LED to blink on and off. This can also serve to attract attention to the device. For a residential application however, most consumers do not want to have a blinking LED marking their doorbell, driveway, or sidewalk. Operating the LED on a continuous basis may be more attractive to consumers, but would require substantially more power.

Reflector based markers and some types of landscape lights could also benefit from a long life battery powered luminaire. Roadside, bicycle and driveway reflector products are very effective when a bright source of light shines directly on them. Otherwise, such reflectors are ineffective. A self-lighted marker has the advantage of being visible without an external source of light directed on it, so that it is visible to walkers, joggers and bicyclists at night. Such a marker would also be useful in driving situations where the marker is outside the normal field of the car's headlights. Roadside reflectors have been proposed that have made use of solar charging systems for batteries. Rechargeable batteries are bulky and the solar cells and recharging circuits can add substantially to the relative cost of the product. Solar cells must be placed in locations that receive direct sunlight during some part of the day, and, as a consequence, may not work in a shaded location. During winter at high latitudes very little sunlight is received, reducing the effectiveness of these products.

Under conditions of darkness, it does not require much light output to make an object visible. The human eye has great light intensity adaptability. The differences in eye sensitivity between conditions of bright sunlight (photopic vision) and fully night adapted vision (scotopic vision) can vary by a factor of 25,000 and instances of adaptation up to a factor of 1,000,000 times have been documented. Multiple mechanisms within the eye provide this adaptability, some responding quickly to changing light conditions, e.g. pupil dilation, and some slowly, e.g. maximum rod sensitivity, so that fully night adapted vision is not achieved for up to 30 minutes. The implication of this is that levels of light useless under normal indoor lighting conditions, can become useful under conditions where one can anticipate people will have adapted to darkened conditions. The spectrum of light generated makes a difference in the minimum radiant intensity required for human perception. Generally people can see broad spectrum or white light more readily than they can see narrow spectrum light of the same intensity.

Visible spectrum applications of light emitting diodes have long included simple status indicators and dynamic power level bar graphs. Display applications have grown in number and super bright LEDs are used in various automotive and traffic signal applications. Super bright LEDs are extremely efficient in terms of the percentage of input power converted to visible radiation compared with devices previously known. This is one reason they are favored for applications requiring the output of high intensity light. Super bright LED devices are available which emit any one of a variety of colors, or which emit broad spectrum radiation. Some super bright LEDs also work over broad ranges of drive currents and emit low intensity light at low drive currents and with low power consumption. These LEDs exhibit efficiencies at low power levels comparable to the high efficiencies achieved at the much higher power levels at which they are designed to operate. U.S. Pat. No. 6,140,776 to Rachwal teaches a flashlight that exploits low power operation of super bright LEDs in one application.

SUMMARY OF THE INVENTION

The invention provides a marker luminaire combining a super bright LED and a low energy drive circuit to promote long battery life. Such a luminaire comprises a housing and a lamp disposed in the housing capable of producing light visible to a partially darkness adapted human eye. A minimal current is selected to produce enough light to be seen at the desired distances. A light scattering element is optically associated with the lamp to make the marker light visible across a wide viewing angle and thereby indicate the location of the housing. The electrical drive circuit provides the minimal current to the lamp. The electrical drive circuit may further comprise a photosensitive element responsive to high and low ambient light conditions for cycling operation of the LED. A replaceable electrical power cell is positioned in the housing in the electrical drive circuit as a power source.

The terms white light and broad spectrum radiation are used broadly in this patent. The present invention uses LEDs which emit a spectrum blend of visible light on an illuminated surface at a near minimum intensity level which produces a physiological response in a normal human eye. The terms white light and broad spectrum are thus used in the sense of any spectrum output producing greater perceived brightness than monochrome radiation generated at the same energy level.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of illustrative embodiments when read in conjunction with the accompanying drawings, wherein:

DETAILED DESCRIPTION OF THE INVENTION

Due to the nature of the human eye, monochrome LEDs operating at the same efficiency as a broad spectrum or white light LED require substantially more current than do the broad spectrum LEDs to achieve the same perceived brightness level. Since contemporary monochrome super bright LEDs do not exhibit substantially greater efficiencies in light generation compared to broad spectrum LEDs, super bright white LEDs may be operated at a current which is small fraction of the rated current for the diode, and at a lower current than a monochrome LED, and still provide a level of illumination useful as a marker for darkness adjusted vision. At the time this patent was written, broad spectrum LEDs are preferred for the marker applications described herein. However, should technical developments lead to monochrome or limited spectrum LEDs exhibiting much higher efficiencies than white LEDs, than such devices might also produce perceptible light at a lower current than a white LED and come to be preferred for many of these applications.

A luminaire used for marking the location of an object need not be particularly bright under circumstances where it can be expected that a person looking for the object will have partially darkness adapted vision. Contemporary, super bright, white LEDs rated at 15 to 20 milliamps can be operated in ranges extending from just below 5 milliamps to a few microamps and produce perceptible light. Extraordinarily long battery life for a luminaire can be achieved at these current levels. Battery life can be further extended by turning the LEDs on and off based on the need for light. For example, an ambient light sensitive control circuit may be used to turn off the luminaire during daylight. Using the low-level white LED approach and a daylight sensor, it is possible to obtain battery life in the range of 1–3 years for some applications using typical small lithium coin cells.

Figure 1:
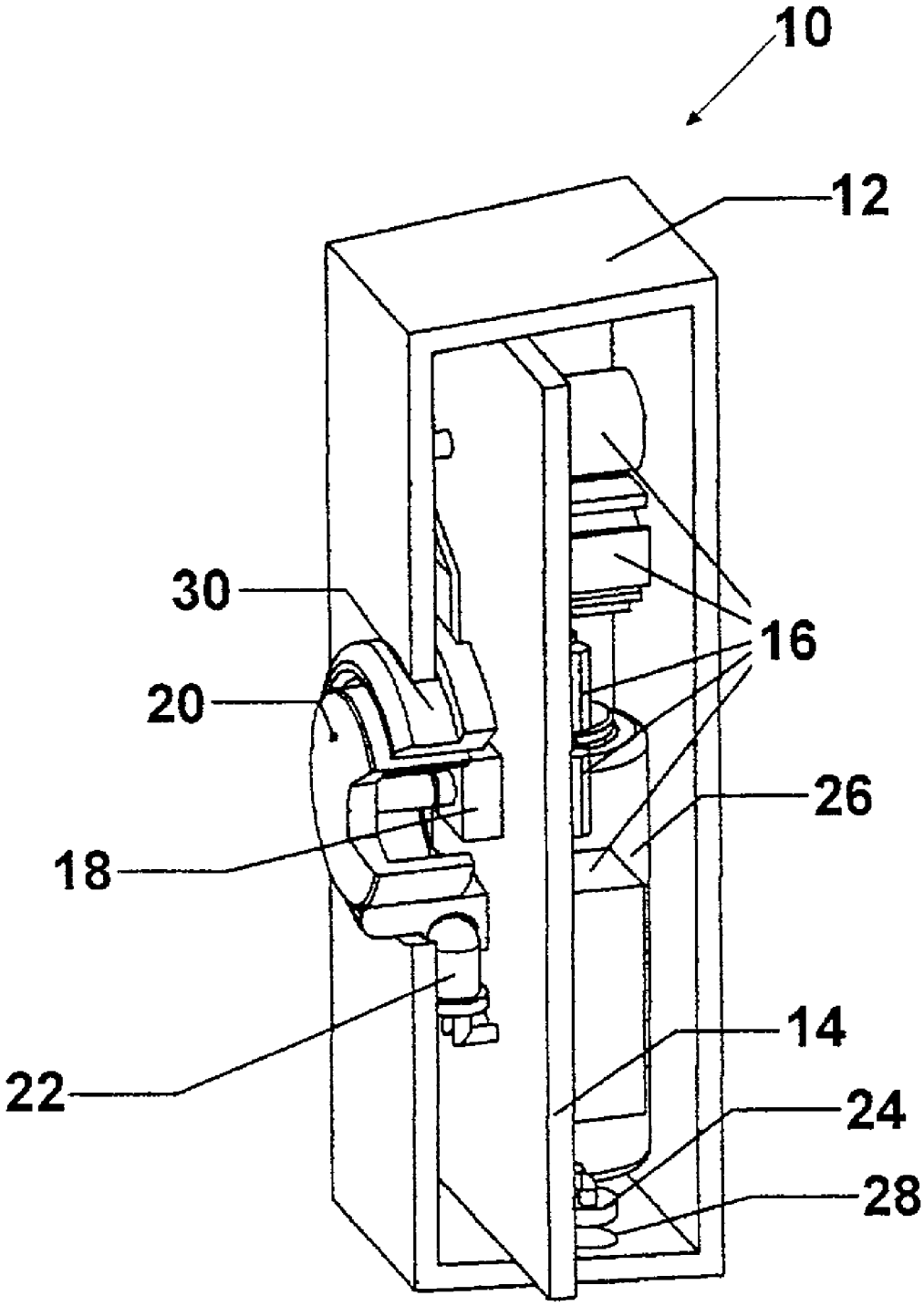
FIG. 1 is a partial cutaway view of a wireless doorbell transmitter in accord with the invention.

FIGS. 1–4 illustrate in a series of cut-a-way views battery operated wireless doorbell transmitters in which an embodiment of the invention is incorporated. In FIG. 1 a wireless doorbell transmitter 10 comprises a plastic case 12 which in turn encloses a printed circuit board 14. Printed circuit board 14 mounts circuitry 16 used to transmit an encoded RF signal when a switch 18, which is positioned directly behind a push-button 20, is closed by the action of pressing the push-button. Circuitry 16 is further arranged so that the current used to generate the RF signal passes through a light emitting diode (LED) 22 causing it to illuminate, and resulting in visible confirmation that the RF transmission has occurred. The RF transmission current would typically be several milliamps. If the LED 22 is a high efficiency type typically known as Super Bright, the LED will light brightly enough to be easily seen even on a sunlit day.

Circuitry 16 includes a cadmium sulfide (CdS) light sensor 24 for causing a low level current to pass through the LED 22 when the ambient light level is below a predetermined threshold. If LED 22 is a super bright type of LED that exhibits high efficiency light generation at low current levels, a "glow-in-the-dark" illumination level can be achieved using a very low LED drive current. The combination of a very low glow-in-the-dark current level and the ability of the CdS light sensor 24 to turn the LED 22 off during the day minimizes the total current required from battery 26 and results in long battery life. Wireless doorbell transmitter 10 emits no light when ambient light is sufficient to allow the unit to be seen without aid, emits a low level of light to mark its location during times of darkness, and emits high intensity light, visible during daylight, in response to use to indicate operation. A single type A23 alkaline cell is sufficient to provide a year or more of service. The small battery size in turn permits use of a case 12 roughly comparable is size to conventional doorbell button cases.

A light sensor opening 28 through the bottom portion of case 12 allows ambient light to enter the case and fall on the CdS light sensor 24. A clear lens can be placed in the light sensor opening 28 if sealing the case 12 is considered desirable. Alternatively, case 12 can be made from a translucent or transparent material that allows a useful amount of ambient light to pass through and fall on the CdS light sensor 24.

LED 22 is positioned very near, or partially within, and optically coupled to, a translucent ring 30. When activated, either by the switch 18 or the CdS light sensor 24, LED 22 emits light which is coupled into the ring 30 and produces a glow which surrounds push-button 20. The translucent material of ring 30 scatters the light and distributes it throughout the ring, which is visible across a broad angle. At night, when the push-button 20 has not been pressed, the ring 30 glows at a low level from light from the LED. A normal eye that has achieved some degree of night adaptation can readily see the ring 30 and identify the push-button 20. Upon push-button 20 being pressed the ring glows at a second, substantially higher level, indicating that the device is operating.

Figure 2:
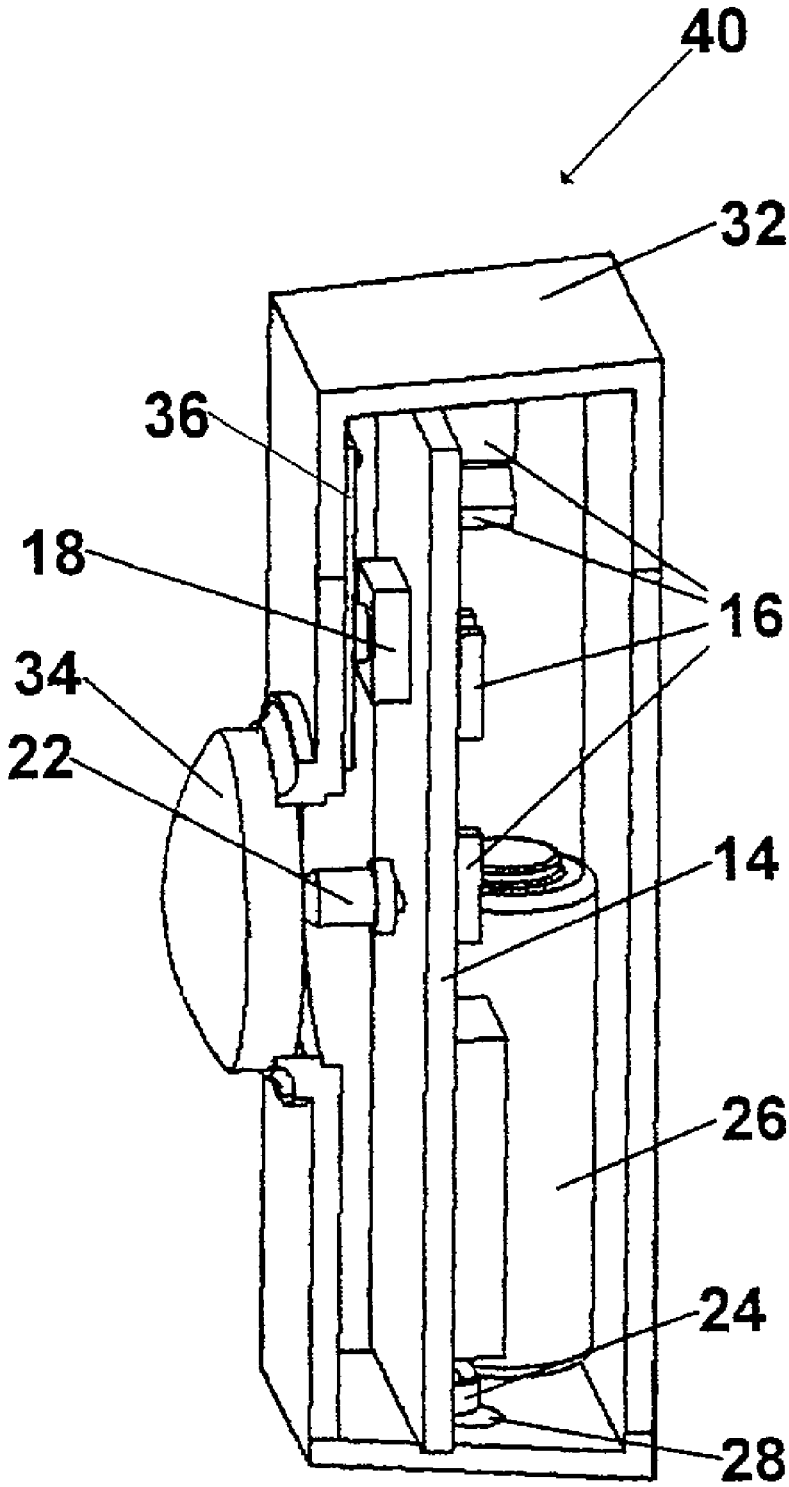
FIG. 2 is an alternative wireless doorbell transmitter in a partial cutaway view.

FIG. 2 shows a cut-a-way view of an alternative embodiment, battery operated, wireless doorbell transmitter 40. Wireless doorbell transmitter 40 is similar to the transmitter shown in FIG. 1, except that no glow ring 30 is present and switch 18 has been offset to allow placement of LED 22 directly behind a push-button 34. Push-button 34 is preferably made from a translucent material diffusing any light emitted by LED 22. A portion 36 of push-button 34 extends over the switch 18 so that the switch is activated when the push-button is depressed. Case 32 is modified as against the case in FIG. 1 to eliminate provision for the glow ring 30.

LED 22 is positioned directly behind the translucent push-button 34 in such a manner that the light from the LED will be directed onto the push-button. When activated either by the switch 18 or the CdS light sensor 24, light from the LED 22 illuminates the push-button 34. The push-button 34 can be clear, translucent, or faceted. Translucent, or faceted materials, diffuse or refract the light from LED 22 and distribute it about push-button 34. Even when made of clear materials, the cylindrical shape of button 34 provides sufficient scattering of light to make the button visible across a wide angle. Under low ambient light conditions, when push-button 34 has not been pressed, the push-button glows at a low level illuminated from LED 22. For push-buttons 34 made from a clear material, light emitted from the LED 22 is directly visible through the push-button. In each case, low level light is visible to a darkness acclimated eye.

Figure 3:
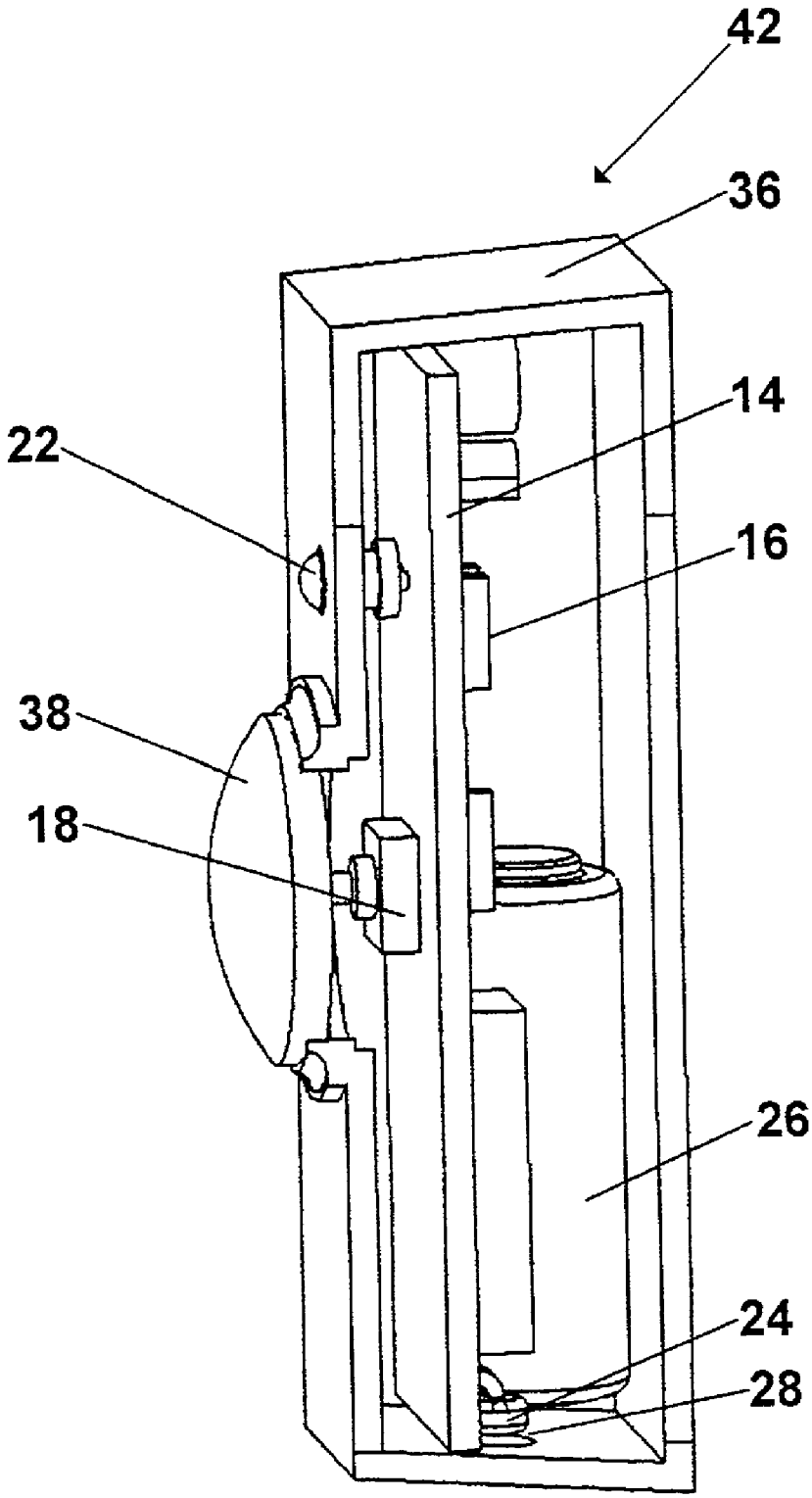
FIG. 3 is another alternative wireless doorbell transmitter in a partial cutaway view.

FIG. 3 is a cut-a-way illustration of yet another embodiment of a battery operated wireless doorbell transmitter 42. The transmitter is similar to the transmitters shown in FIGS. 1–2, except that LED 22 now protrudes through the front of case 36. Push-button 38 is preferably made of an opaque material and is positioned directly over switch 18. Transmitter 42 is generally similar to the transmitter described with reference to FIG. 1. LED 22 itself includes a semiconductor device embedded in a clear plastic material, which is shaped to provide some light scattering.

Figure 4:
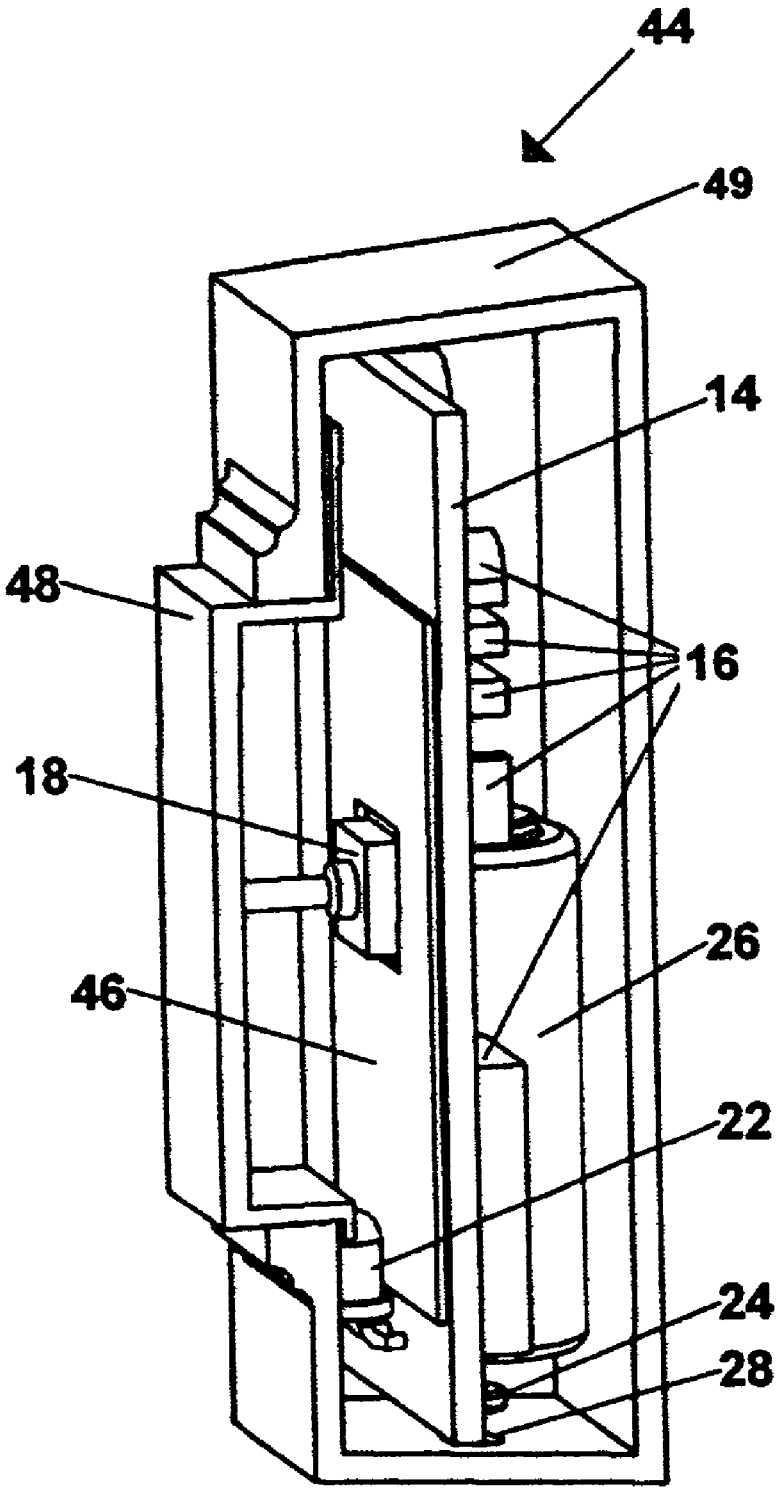
FIG. 4 is yet another alternative wireless doorbell transmitter in a partial cutaway view.

FIG. 4 is a cut-a-way view of still another embodiment of a battery operated wireless doorbell transmitter 44 incorporating a super bright LED and providing two distinct levels of illumination, one lower level for marking the location of the transmitter under low ambient light conditions and another much higher level for indicating operation of the transmitter. The transmitter 44 is similar to those of FIGS. 1–3, however, it incorporates a rectangular push-button 48 and a case 49 modified to incorporate the rectangular push-button. A back light reflector 46 distributes light from LED 22 evenly to the backside of push-button 48. Light reflector 46 is positioned behind push-button 48 and the LED 22 is positioned below the reflector and oriented to cast light upward toward the light reflector and the push-button in order to illuminate the push-button's back face. The light pattern created by LED 22 is typically a cone that starts at the tip of the LED and is symmetrical about the LED's central axis as it expands away from the LED's tip. This central axis of the cone of light extends parallel to and behind the push-button 48, aligned with the direction of elongation of the push-button. The light cone expands away from the LED 22, intersecting the push-button 48 where the light is diffused by the translucent material of the push-button causing the push-button to glow. However, direct illumination from LED 22 is not of uniform intensity since the back surface of the push-button 48 is not a uniform distance from the LED. Much of the light emitted by LED 22 does not directly strike push-button 48 and would not add to the brightness of the push-button without reflector 46 from a wide angle due to the light scattering properties of the push-button.

Reflector 46 is preferably arranged and shaped so that much of the light from LED 22 that does not directly strike the push-button 48 will strike the light reflector and be reflected back onto the push-button. This reflected light adds to the brightness of push-button 48 and also reduces the intensity of light variations across the face of the push-button. Light reflector 46 is usually a flat surface, but can also be a curved or angled surface. The shape and angle of the light reflector's surface can be set in conjunction with the position and angle of the LED 22 to minimize variations in light intensity across the surface of the push-button 48. At night, when the push-button 48 has not been pressed, the push-button will glow at a low illumination level in response to the light from the LED 22 and reflected off of light reflector 46. For an eye that has achieved some degree of night adaptation, the illumination level is sufficient that push-button 48 can be readily located.

Figure 5:
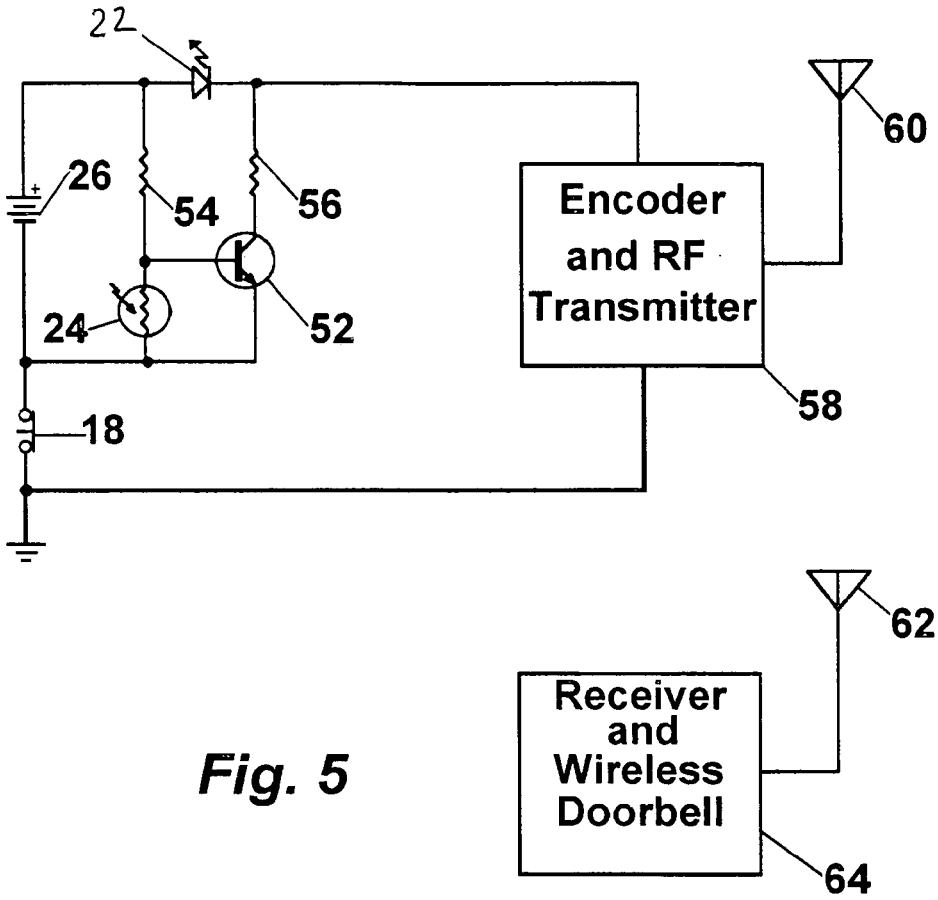
FIG. 5 is a detailed circuit schematic for the wireless doorbell transmitters of FIGS. 1–4.

FIG. 5 is a circuit schematic for the wireless doorbell transmitters of FIGS. 1–4. Encoder and RF circuitry 58 along with the RF antenna 60 are shown only in block diagram form and can be implemented in a multitude of ways that are well known in the art. Coded signals broadcast by encoder and RF transmitter 58 and antenna 60 are received by a receiver and wireless doorbell chime unit 64 over an antenna 62.

Power is supplied to the illumination control circuitry 16 and to encoder and RF transmitter circuitry 58 from a battery 26, which preferably comprises a single A23 style alkaline cell. A momentary switch 18 connects, when closed, the encoder and RF transmitter circuitry 58 to battery 26 resulting in an encoded RF transmission. Switch 18, battery 26, LED 22, and encoder and RF transmitter 58 are connected in series. When encoder and RF transmitter 58 is operating, it draws several milliamps and, as a result, LED 22 glows brightly. When momentary switch 18 is open, encoder and RF transmitter 58 are disconnected from the battery 26 to prolong battery life.

With momentary switch 18 open, any current flowing through LED 22 must be sunk by a bipolar transistor 52. Battery 26, LED 22, resistor 56 and an NPN bipolar transistor 52 are connected in series. Conduction of the transistor 52 is controlled by a voltage divider circuit connected between the positive and negative terminals of battery 26 and comprising a resistor 54 and the CdS light sensor 24. The base of transistor 52 is connected to tap the voltage between resistor 54 and the CdS light sensor 24.

CdS light sensor 24 is a light sensitive resistor whose resistance depends inversely on the amount of light that falls on it. When ambient light levels are relatively high, the resistance of the CdS light sensor will be low and the current flowing through resistor 54 will be diverted around the base-emitter junction of transistor 52. In other words $V_{BE}$ will be low and transistor 52 will be in cut off. With transistor 52 in cut off, no current flows through LED 22. During daylight hours, the primary current flow is through resistor 54, which is chosen to have a resistance on the order of 10 Mohms. This high value resistance limits current drawn from the battery 26 to a minimal level, prolonging the battery's life. As ambient light levels decrease, the resistance of the CdS light sensor 24 increases, and the base current into transistor 52 likewise increases until transistor 52 begins operating. With transistor 52 conducting, current flows through LED 22 and resistor 56. A value for resistor 56 is chosen to limit the current to a low level, preferably about 5 micro amperes.

LED 22 is of a type commonly known as Super Bright and is further of a type that maintains its light producing efficiency even at very low current levels. In addition, the LED should be of a type that produces relatively white or broad spectrum light, which has a perceived brightness greater than that produced by a monochrome LED of equal intensity. One particular LED that meets these requirements is part number NSPW310BS available from Nichia America Corporation. Even at a very low forward current, this type of LED provides enough illumination to be visible to eyes that are at least partially dark-adapted.

Figure 6:
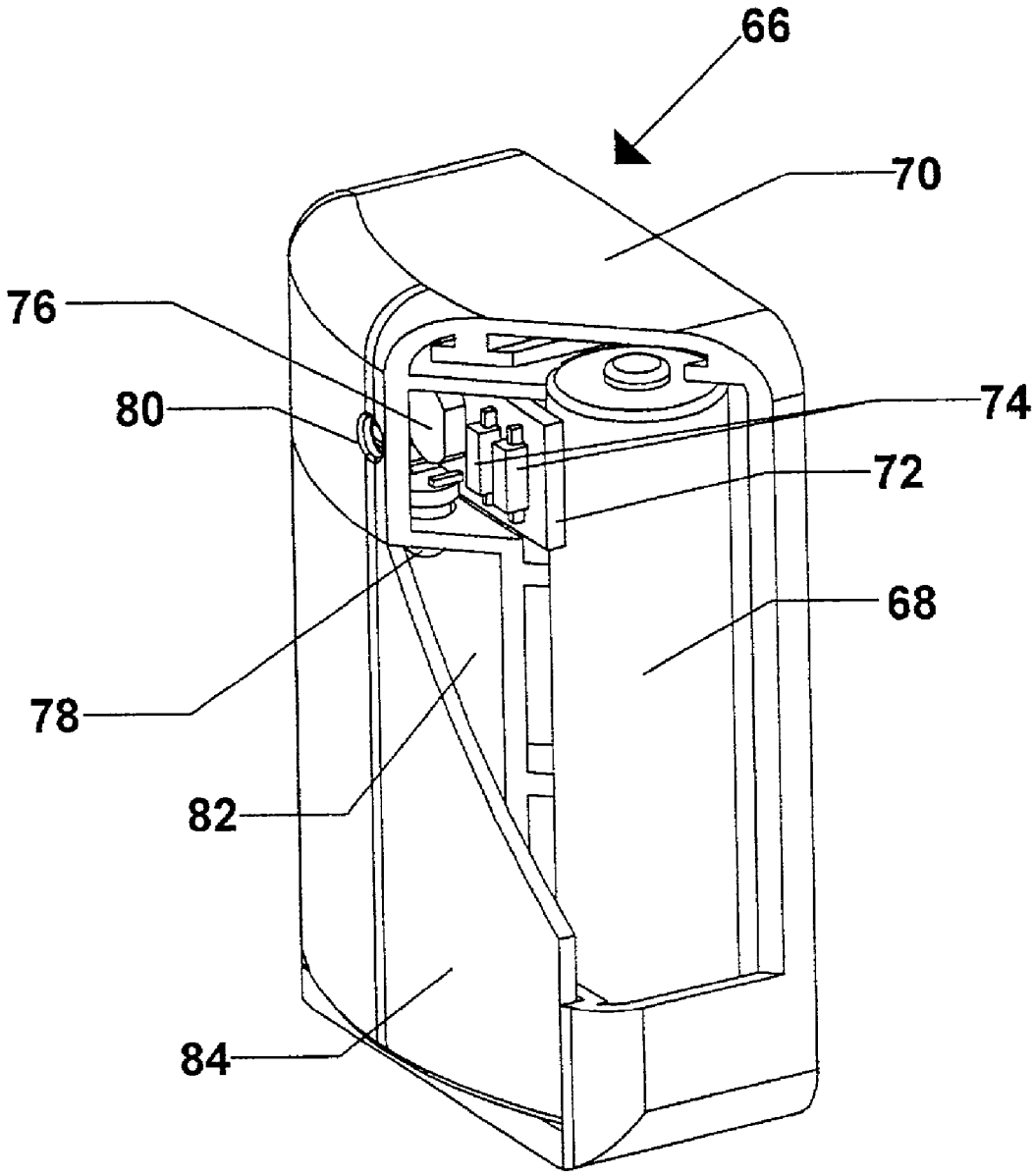
FIG. 6 is a perspective view in partial cut-a-way of a portable marker luminaire.

FIG. 6 is a cut-a-way perspective view of a battery-operated marker light 66. Marker light 66 provides low level illumination for one year or more on three AAA alkaline cells forming a battery 68 (one cell is shown). The illumination level is not intended to be useful for photopic vision, but rather to provide a useful illumination level for eyes that have achieved some level of night adaptation. Under these conditions (scotopic vision), enough illumination is provided to clearly mark walls, doorways, or other objects. If the eyes are fully night adjusted, enough illumination is provided to carry out simple tasks without requiring any additional lighting.

A plastic case 70 encloses a printed circuit board 72 that contains circuitry 74 which uses a CdS light sensor 76 to turn the marker light 66 on or off in response to ambient light conditions. Plastic case 70 also encloses the batteries 68 that supply power for the circuitry 74 and a super bright LED 78. The circuitry 74 passes a low level current through the LED 78 when the ambient light level is below a predetermined threshold. If a Super Bright LED of the type that maintains its efficiency at low current levels is used for LED 78, a "glow-in-the-dark" illumination level can be achieved using very low current levels. Very low current levels, combined with the ability of the CdS light sensor 76 to turn off the LED 78 during the day, minimize the current that is required from the Battery 68. Battery lifetimes of a year or more can be achieved using three AAA alkaline cells, allowing use of a compact package.

A light sensor opening 80 in the front of case 70 allows ambient light to enter the case and fall on the CdS light sensor 76. A clear lens could be placed in the light sensor opening 80 if an open hole is undesirable. Alternatively, case 70 can be made from a translucent material that allows ambient light to pass through and fall on the CdS light sensor 76.

Case 70 further includes a light reflecting surface positioned behind a translucent lens 84, which in turn forms a substantial portion of the front of the case. LED 78 is positioned within case 70 above and just behind translucent lens 84, but forward of light reflecting surface 82. LED 78 is oriented to cast light downwardly both onto the light reflecting surface as well as directly on the translucent lens 84. The pattern of light created by LED 78 is typically a cone with its point at the LED's tip that expands symmetrically about the LED's central axis in a direction away from the LED. Where the cone of light intersects the translucent lens 84, the lens scatters the light causing the lens to glow and to become visible from a wide band of viewing angles relative to the case 70. However, the glow is not of a uniform intensity since the translucent lens 84 has a curved surface and various areas of the lens are at different distances from LED 78. Much of the light emitted by LED 78 does not directly strike lens 84 and thus does not add directly to the brightness of the lens.

Much of the light from the LED 78 that does not directly strike the translucent lens 84 strikes the light reflecting surface 82 and is reflected back onto the lens. Light reflecting surface 82 is illustrated here as being a flat surface. Appropriate shaping and variation of the slope of surface 82, for example by introducing curves thereto or by changing its angle of repose, can be done to vary the angle of incidence light falling thereon from LED 78 and even the distribution of light. Similarly, local changes to the reflectivity of surface 82 can reduce light intensity variations across the face of the lens 84, at some loss of efficiency. The shape and angle of the light reflecting surface 82 can be set in conjunction with the position and angle of the LED 78 to minimize variations in light intensity across the surface of the translucent lens 84. Under low ambient light conditions translucent lens 84 glows in response to the light from LED 78 and from the light reflecting surface 82. After the eye has achieved some degree of night adaptation, the illumination level is sufficient to be useful as a marker light.

Figure 7:
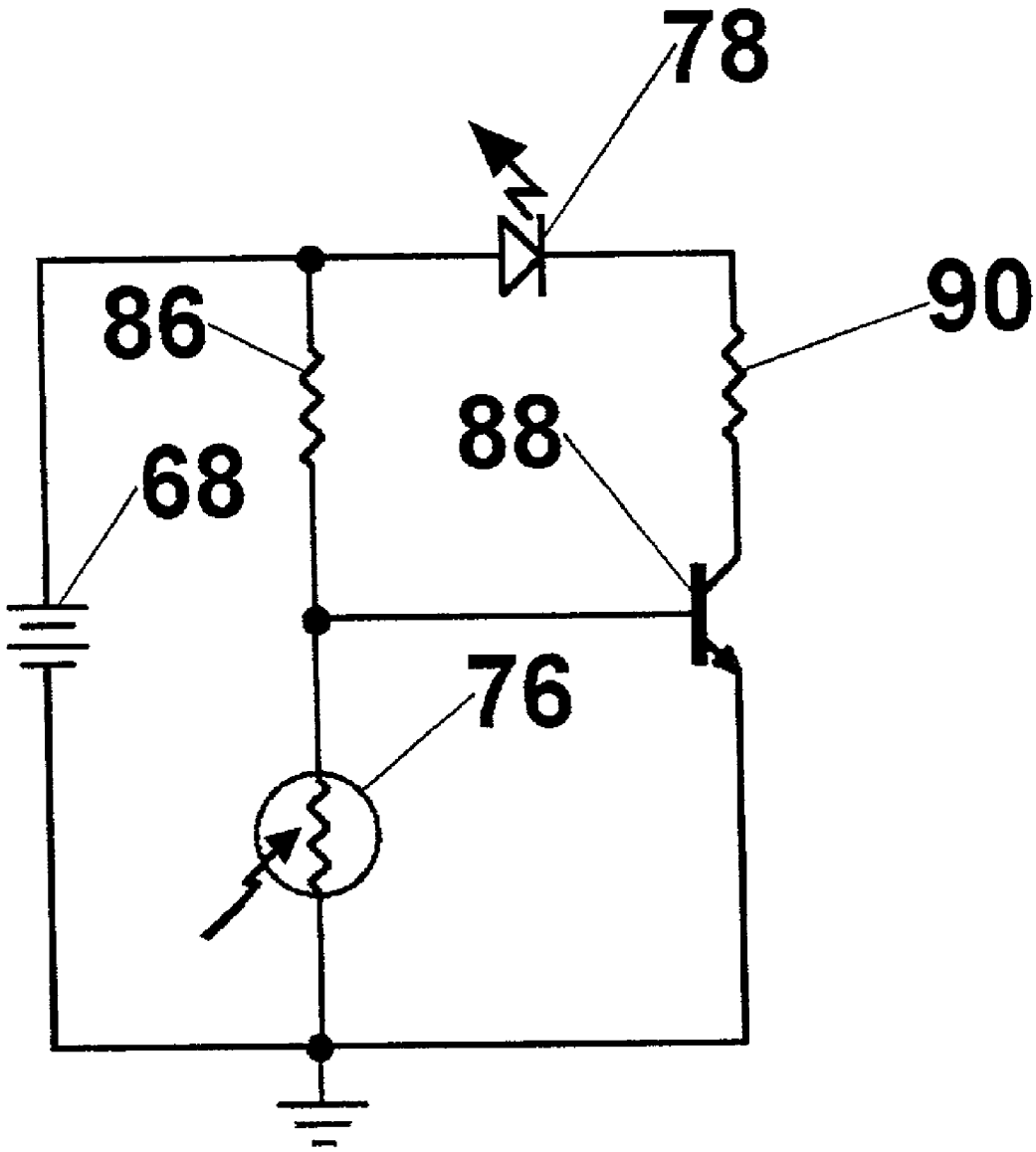
FIG. 7 is a circuit schematic for the luminaire of FIG. 6.

FIG. 7 is a circuit schematic for battery powered marker light 66 of FIG. 6. Battery 68 preferably comprises 3 AAA cells and is connected into a circuit that controls illumination of LED 78 in response to ambient light levels. Attached in series across the cathode and anode of battery 68 are a resistor 86 and a CdS light sensitive resistor 76, the resistance of which depends inversely on the level of ambient light.

Operation of marker light 66 is light sensitive. When ambient light levels are relatively high, the resistance of the CdS light sensitive resistor 76 is low and current flowing through resistor 86 is diverted around the base-emitter junction of transistor 88. Transistor 88 remains off and no current flows through LED 78. Resistor 86 is chosen to have a resistance such that current drawn from battery 68 by circuit paths including the resistor (i.e. the path including resistor 86 and light sensitive resistor 76 and the path formed by resistor 86 and the base to emitter junction of npn transistor 86) is extremely low, with the result that battery life is little effected. As the ambient light level decreases, the resistance of the CdS light sensitive resistor 76 increases, increasing the base current of transistor 88. Transistor 88 turns on and causes current to be sunk at the transistor's collector.

Current sunk at the collector of transistor 88 is drawn through a circuit path formed by LED 78 and resistor 90. Resistor 90 has a value chosen to limit this current to a low level as required to achieve reasonable battery life, but sufficient to provide illumination for scotopic vision. For a fully charged battery 68, the initial glow-in-the-dark current is set to about 250 micro amperes, but gradually decreases as battery 68 discharges. LED 78 is of a type commonly known as Super Bright that maintains its light producing efficiency even at very low current levels. In addition, if the LED is of a type that produces relatively white or broad spectrum light, the perceived brightness will be greater than that produced by a monochrome LED of equal intensity. One particular LED that meets these requirements is part number NSPW310BS available from Nichia America Corporation. Even at low forward currents, this type of LED provides enough illumination to be useful for eyes that are at least partially dark-adapted.

Figure 8:
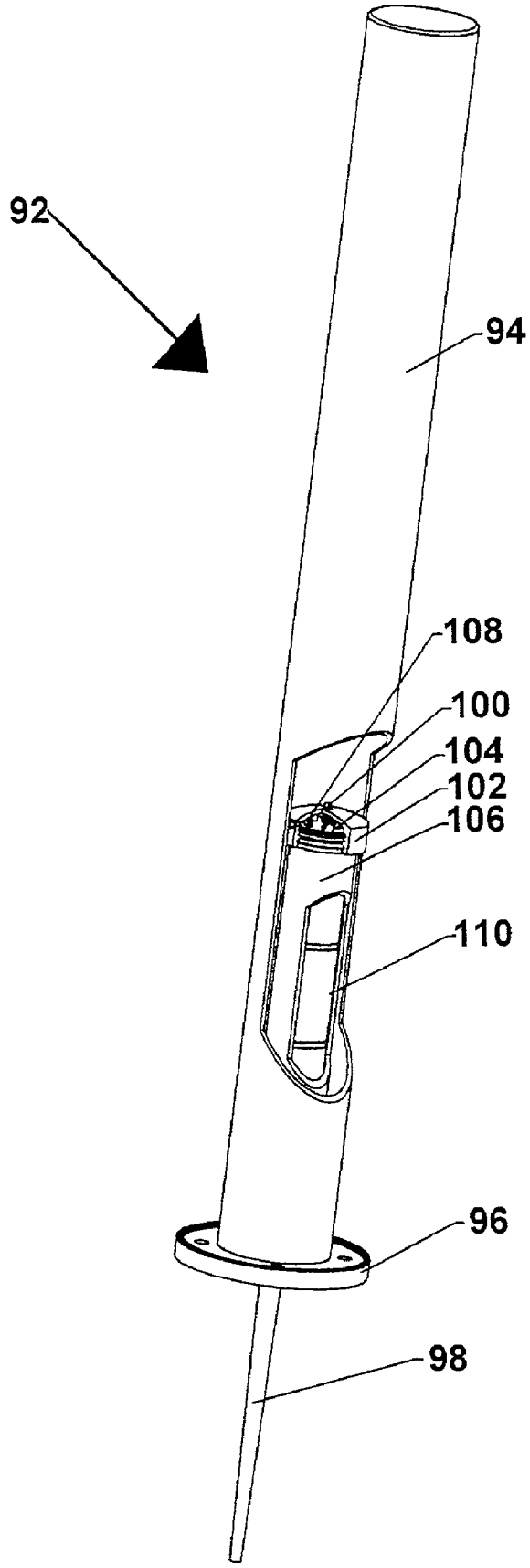
FIG. 8 is perspective view in partial cut-a-way of a driveway marker luminaire.

FIG. 8 is a partial cut-a-way view in perspective of a battery powered driveway marker 92. The driveway marker provides low levels of illumination for one year or more based on a battery 110 comprising four alkaline D cells. Marker 92 comprises a translucent, light scattering, rigid tube 94 which is mounted on one face of a substantially flat, disk-like base 96. Extending from the opposite face of base is a positioning spike 98, which allows the marker to be planted in the ground along a driveway or sidewalk. Tube 94 glows from internally generated light emitted by an LED 100. A portion or all of tube 94 may be hollow in order to enclose an internal structure that houses the battery 110 and the electronic circuitry needed to control LED 100. LED 100 is of the type commonly know as super bright and glows visibly at a current as low as 4 or 5 milliamps, which is substantially below the LED's rated output. Such a current level can be supported by battery 110 for over a year if drawn only at night. Light emitted by LED 100 shines upwardly from the LED's position in a battery housing cover 102 in the lower portion of tube 94. The intensity of light at any particular point along the surface of tube 94 is usually insufficient for photopic vision, but is visible to eyes which have adapted to night vision. Under low ambient light conditions (scotopic vision), enough illumination is provided to make tube 92 clearly visible.

A battery housing 106 located in the lower portion of the tube 94 encloses battery 110, a printed circuit board and associated circuitry 104 and a light sensitive resistor 108. Housing 106 is closed at its upper end by a cover 102. LED 100 is mounted on the printed circuit board 104 and extends upwardly from housing 106 and through the center of cover 102. Light sensitive resistor 108 is also mounted on the printed circuit board 104 along with circuitry to control the current supplied to the LED 100. An opening (not shown) in the housing cover exposes the light sensitive resistor 108 to ambient light conditions reaching the sensor through the tube 94. The housing cover 102 and housing 106 are cooperatively threaded to allow mounting of the cover to the housing. Contacts within housing 106 and on the bottom of the printed circuit board 104 connect battery 110 to the circuitry on the board.

When compared with landscape lights, the driveway marker lights of the present invention exhibit the advantage of being self-contained. As such, installation of the product is very simple. This is especially important because driveway markers are often located at points that are the most remote within the yard from a source of power. Compared with solar products which also eliminate the hassle of wiring installation, this product is not dependent on sunlight to recharge batteries, which is a severe limitation for solar technology and it is also less costly because there are no solar panels, nor rechargeable batteries.

Figure 9:
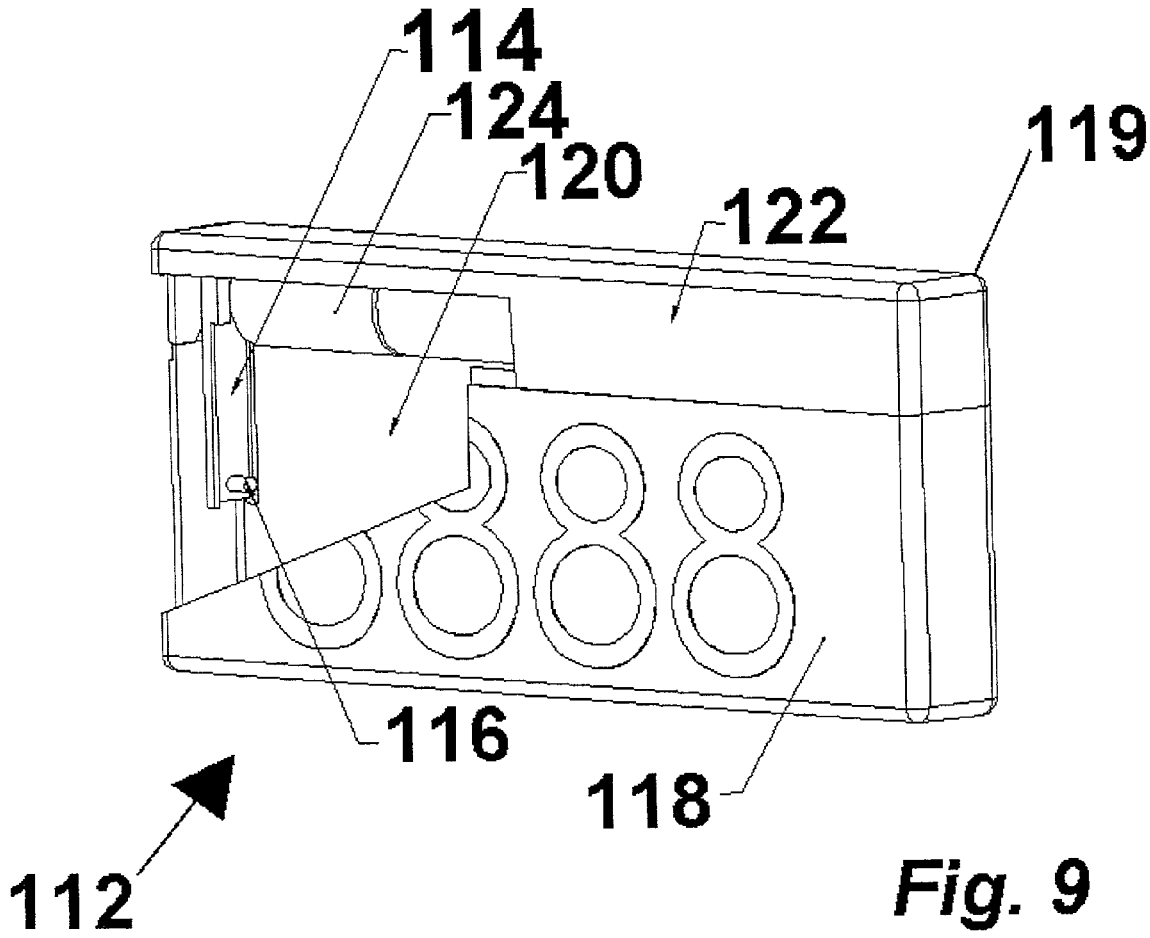
FIG. 9 is a perspective view in partial cut-a-way of an illuminated address sign.

An alternative application of the driveway marker electronics is a battery powered address sign 112, illustrated in FIG. 9. Address sign 112 is a flattened rectangular case 119 which has a translucent, light scattering display area 118 forming a portion of a front face of the case and a battery enclosure 122 located over the display area. Within case 119, both behind and to one side of display area 122, is an LED 116. LED 116 is oriented to direct light across the case 119 behind the display area 118. LED 116 is mounted on a circuit board 114, which may also be used to support a light sensitive resistor (not shown). Along a back wall of case 119, opposite the translucent display area 118, is a reflective surface 120. Reflective surface 120 provides for a more even distribution of light from LED 116 across the display area 118. A battery 124 comprising four size D alkaline cells is located in battery enclosure 122.

Figure 10:
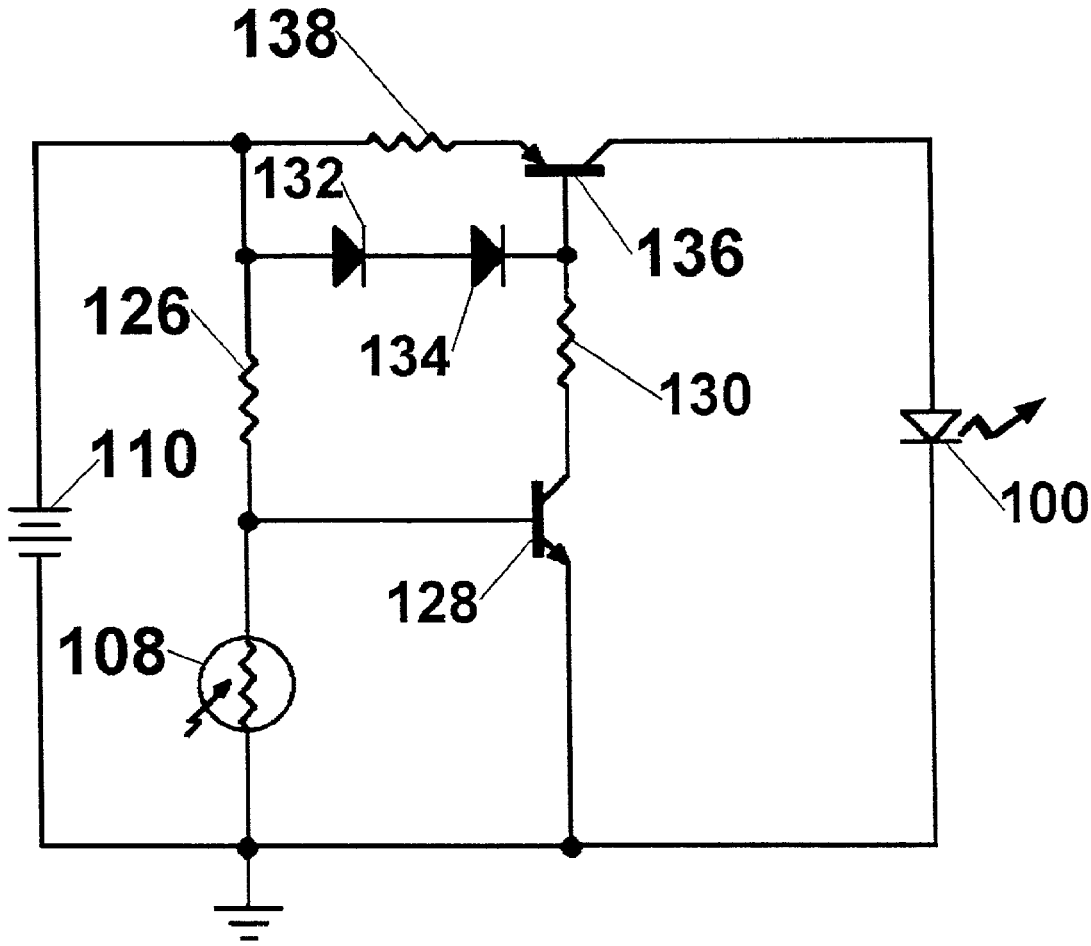
FIG. 10 is a circuit schematic for the luminairies of FIGS. 8 and 9.

FIG. 10 is a circuit schematic for driveway marker 92 and suitable for use with address sign 112. Power is supplied to glow-in-the-dark circuitry by battery 110. The control circuitry provides two series connected resistors, resistor 126 and light sensitive resistor 108 connected between the cathode of battery 110 and its anode. The base of transistor 128 is connected between resistor 126 and resistor 108. The CdS light sensitive resistor 108 in effect controls the base current, and thus the conduction state of an npn transistor 128. The resistance value for resistor 108 depends inversely on the amount of light that falls the resistor/sensor. When ambient light levels are relatively high, the resistance of resistor 108 is low and the current flowing through resistor 126 primarily passes by resistor 108 to ground. When ambient light levels are low, the resistance value of resistor 108 increases, and base current is directed into transistor 128, driving the transistor into conduction. The resistance value chosen for resistor 126 is high enough, on the order of one megaohm, that the current drawn by any path including resistor 126 is negligible in terms of the current's effect on battery life.

Transistor 128 in turn controls a current source feeding LED 100. When transistor 128 is conducting, current flows through a pair of series connected diodes 132 and 134, which connect the base of pnp transistor 136 to the cathode of battery 110. The current from diode 134 passes further through resistor 130 and from the collector to the emitter of transistor 128. The forward bias drop across diodes 132 and 134 provides a substantially fixed emitter to base bias for transistor 136 driving the transistor into conduction. Transistor 136, when on, functions as a current source feeding LED 100, which is connected by one terminal to the collector of the transistor. A resistor 138 connected between the emitter of transistor 136 and battery 110, limits the amount of current sourced to a level consistent with long battery life.

The value for resistor 138 is chosen to limit this glow-in-the-dark current to a low level as required to achieve reasonable battery life, e.g. about 4 milliamps. LED 100 is of a type commonly known as Super Bright. In addition, if the LED is of a type that produces relatively white light, the perceived brightness will be greater than that produced by a monochrome LED of equal intensity. One particular LED that meets these requirements is part number NSPW315BS available from Nichia America Corporation. This type of LED provides enough illumination to be useful for eyes that are at least partially dark-adapted. Using the low-level white LED approach, it is possible to light the luminaire and still achieve typical battery life of one year or more. In combination with a daylight sensor, battery life can be further extended.

Figure 11:
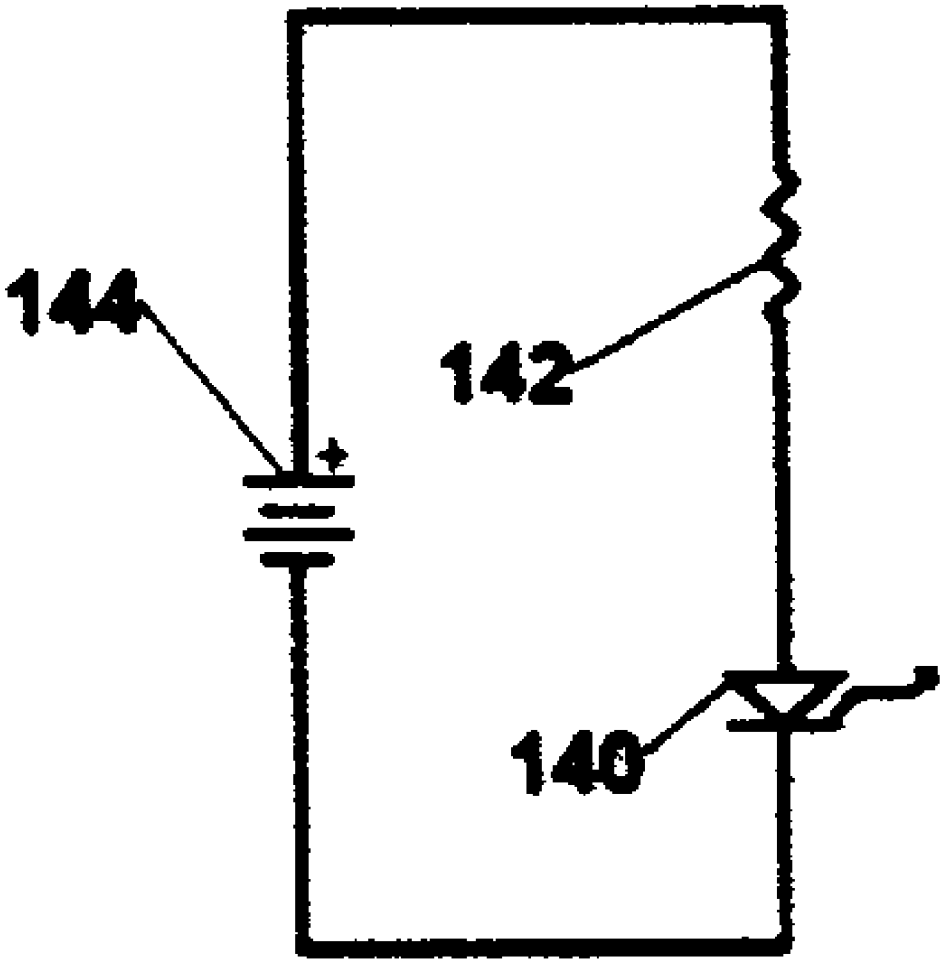
FIG. 11 is a circuit schematic usable with the luminairies of FIGS. 12 and 13.

For applications where duty cycling as a function of ambient light is undesirable, for example areas which are usually dark absent artificial light, the LED drive circuitry may advantageously be simplified. Referring to FIG. 11, a simplified LED 140 drive circuit is taught. A battery 144 comprises a single coin cell to energize super bright LED 140 through a simple series circuit including the cell, a resistor 142 and the LED. The value of resistor 142 is selected so that the current through LED 140 is substantially below the rated value of the LED, as described above for the photo sensitive circuits. Specific component values depend upon the application.

Figure 12:
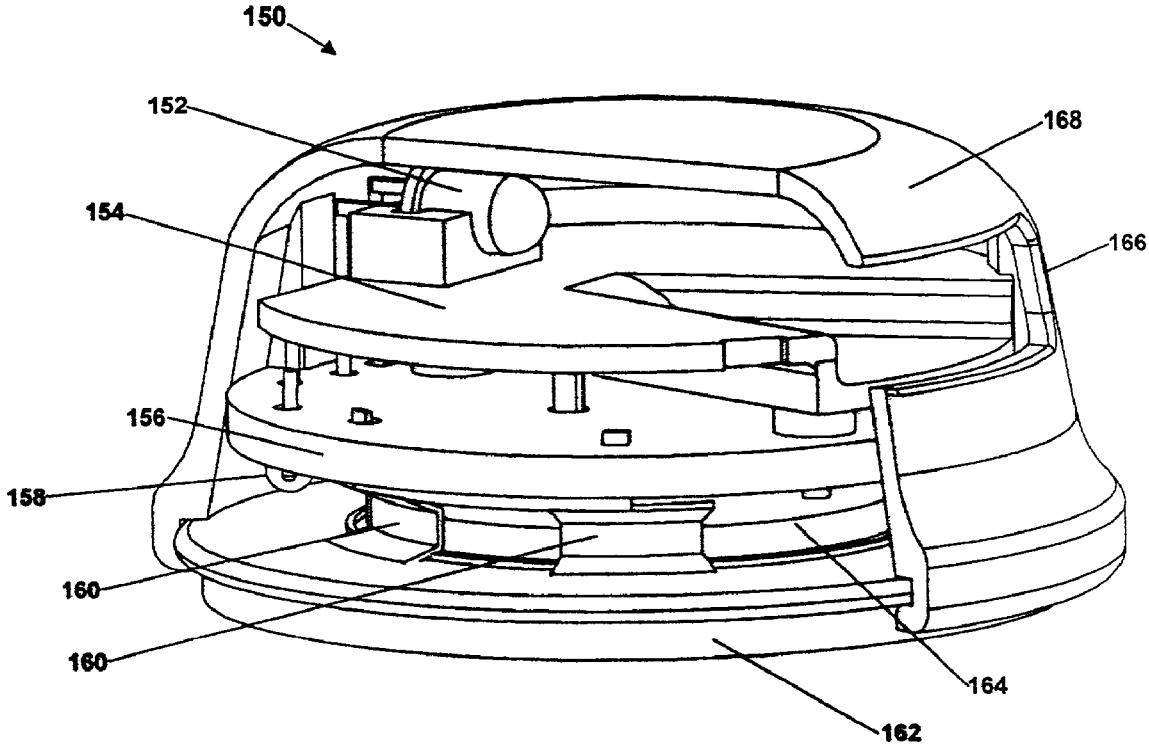
FIG. 12 is a perspective view in partial cut-a-way of coin cell marker luminaire.

FIG. 12 depicts a coin cell marker light 150 which may incorporate either the circuit of FIG. 11, or that of either FIG. 5 or 12, modified for the lower power application. Where the circuit of FIG. 11 is used, a single CR2450 lithium cell is used in series with a resistor chosen to limit forward current to about 70 micro amperes and which gradually decreases as the battery discharges. Alternative circuit arrangements, such as that of FIG. 10, can be applied which will source current at nearly a steady state value until the battery approaches exhaustion. The LED is preferably a broad spectrum type such as the NSPW315BS supplied by Nichia America Corporation.

Coin cell marker light 150 provides a year or more of low level illumination. Coin cell marker light 150 comprises a semi-transparent, faceted, or translucent case top 168 which is roughly bowl shaped and which attaches around the lip of a plate shaped case bottom 162, allowing the case top to be rotated on the case bottom. Case top 168 operates to scatter light impinging on its interior surface. If an optional light opening 166 is provided and the case bottom 162 is attached to a wall or fixture, case top 168 can be rotated to better position the light opening for directing light to illuminate an object or surface.

Mounted within case top 168 is a printed circuit board 156. Attached to the bottom of the printed circuit board 156, between the board and the case bottom 162, are battery cell retainer clips 160, which are arranged in a semicircle and which are spaced to grasp a coin cell 164 pressed in the semicircle. A resistor 158 is also shown attached to the bottom face of printed circuit board 156. Mounted above the printed circuit board 156 is a light reflector 154, and above the light reflector is disposed the LED 152. LED 152 casts light directly onto the translucent case top 168, and onto reflector 154, which reflects scattered light onto the case top. Case top 168 may be colored, playfully shaped, or include an image for projection onto a surface.

Figure 13:
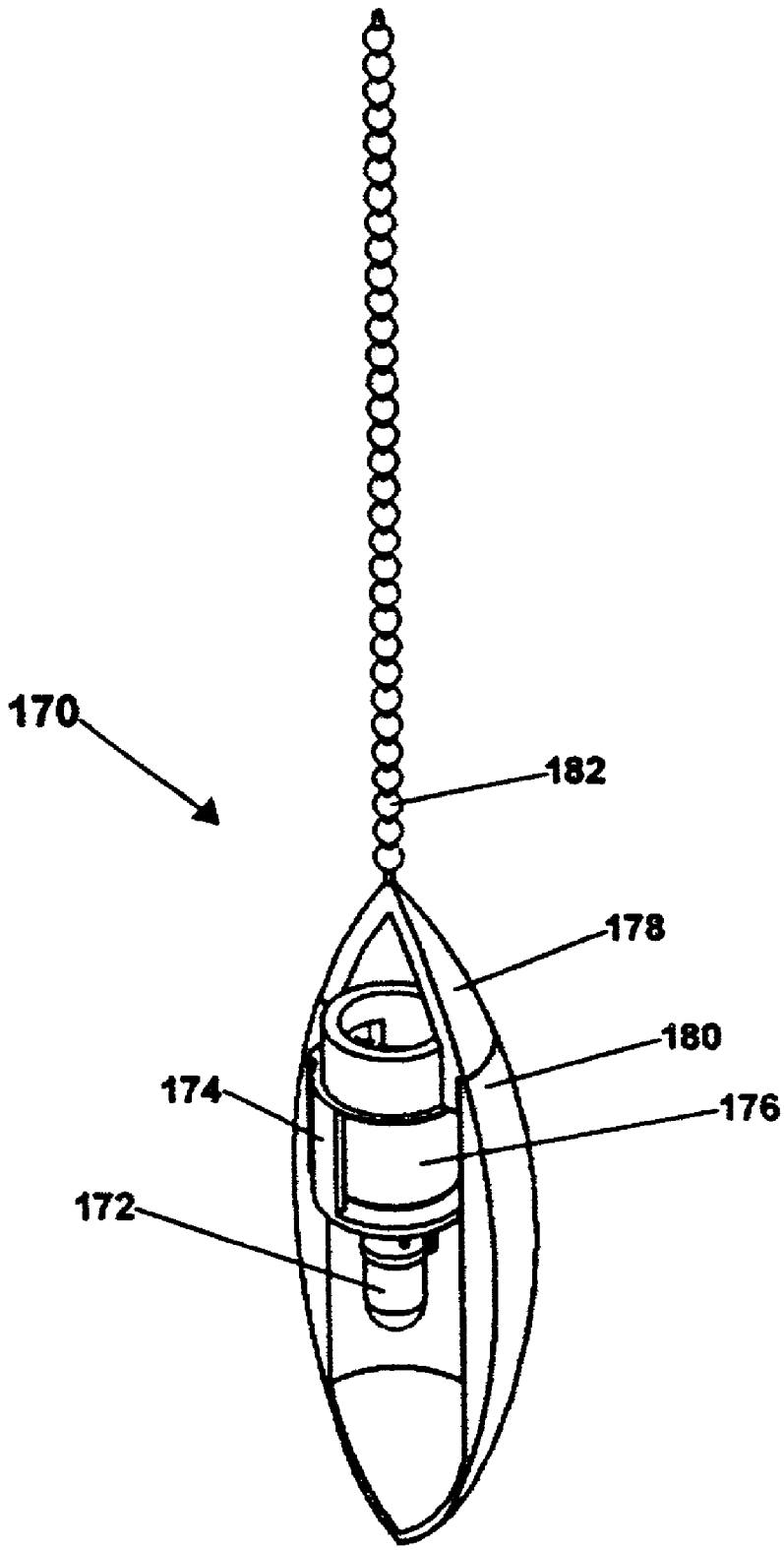
FIG. 13 is a perspective view of a light pull chain luminaire.

Referring now to FIG. 13, another application of the LED energization circuit of FIG. 11 is illustrated. Here a super bright LED 172 is fitted within a pull chain grip 170 formed from a decorative case top 178 and a snap on case bottom 180. Grip 170 hangs from a chain 182. Fitted into the upper portion of case bottom 180 is a battery cell holder 174, which also provides an attachment location for the current limiting resistor (shown in FIG. 11) and a coin cell 176. LED 172 attaches to the bottom of the battery holder 174. Case bottom 180 may provide light scattering.

The invention provides cordless and inexpensive apparata having long battery life for marking the location of objects and enabling them to be found under conditions of darkness.

While the invention is shown in only a few of its forms, it is not thus limited but is susceptible to various changes and modifications without departing from the spirit and scope of the invention.

What is claimed is:

1. A marker luminaire comprising:

a housing having an exterior and an interior;

a light emitting diode located in the interior of the housing;

a light transmitting element optically coupled with the light emitting diode and having a visible surface open on the exterior of the housing through which light is visible over a broad angle viewing angle; and a low current level energization circuit operably connected to the light emitting diode for supplying current to the light emitting diode to cause the light emitting diode to illuminate the visible surface of the light transmitting element at an intensity level below a useful threshold of human photopic vision and above a threshold of scotopic vision.

2. A marker luminaire as set forth in claim 1, wherein the light emitting diode emits broad spectrum light.

3. A marker luminaire as set forth in claim 2, wherein the light emitting diode is one of a class of super bright light emitting diodes exhibiting high light generating efficiency at luminescence levels below the threshold of human photopic vision.

4. A marker luminaire as set forth in claim 3, wherein the low current level energization circuit includes a battery.

5. A marker luminaire as set forth in claim 4, wherein the low current level energization circuit includes an ambient light sensitive element for setting a level of current supplied to the light emitting diode.

6. A marker luminaire as set forth in claim 5, further comprising a high current level energization circuit for supplying a transient drive current to the light emitting diode sufficient to cause the luminescence above a useful threshold of human photopic vision.

7. A marker luminaire as set forth in claim 6, wherein the high current level energization circuit includes a radio transmitter.

8. A marker luminaire as set forth in claim 4, the low current level energization circuit further comprising:

a solid state switch operably coupled to the light emitting diode for controlling low current level energization of the light emitting diode; and a photosensitive resistor coupled to the solid state switch to the control the conductive state thereof.

9. A marker luminaire as set forth in claim 8, further comprising:

an encoder and radio transmitter for a wireless doorbell;

a momentary switch connected to activate the encoder and radio transmitter; and the encoder and radio transmitter being coupled to the light emitting diode for drawing energization current through the light emitting diode at a level sufficient to cause the light emitting diode to luminesce at a level perceptible by photopic vision.

10. A marker luminaire as set forth in claim 9, the housing further comprising:

an external button for actuating the momentary switch; and an optical pathway between the light emitting diode and the exterior of the housing.

11. A marker luminaire as set forth in claim 8, the housing further comprising:

an upright translucent tube; and a stake for placement into the ground supporting the upright translucent tube.

12. A marker luminaire as set forth in claim 4, further comprising a radio transmitter connected to draw power through the light emitting diode.

13. A marker luminaire as set forth in claim 4, the housing further comprising:

an upright translucent tube; and a stake for placement into the ground supporting the upright translucent tube.

14. A marker luminaire as set forth in claim 4, further comprising:

internal circuitry; and an external button for activating the internal circuitry.

15. A marker luminaire as set forth in claim 1, wherein the light emitting diode is one of a class of super bright light emitting diodes exhibiting high light generating efficiency at luminescence levels below the threshold of human photopic vision.

16. A marker luminaire as set forth in claim 15, wherein the low current level energization circuit includes a battery.

17. A marker luminaire as set forth in claim 16, wherein the low current level energization circuit includes an ambient light sensitive element for setting a level of current supplied to the light emitting diode.

18. A marker luminaire as set forth in claim 17, further comprising a high current level energization circuit for supplying a transient drive current to the light emitting diode sufficient to cause the luminescence above a useful threshold of human photopic vision.

19. A marker luminaire as set forth in claim 18, wherein the high current level energization circuit includes a radio transmitter.

20. A marker luminaire as set forth in claim 17, the low current level energization circuit further comprising:

a solid state switch operably coupled to the light emitting diode for controlling low current level energization of the light emitting diode; and a photosensitive resistor coupled to the solid state switch to control the conductive state thereof.

21. A marker luminaire as set forth in claim 20, further comprising:

an encoder and radio transmitter for a wireless doorbell;

a momentary switch connected to activate the encoder and radio transmitter; and the encoder and radio transmitter being coupled to the light emitting diode for drawing energization current through the light emitting diode at a level sufficient to cause the light emitting diode to luminesce at a level perceptible by photopic vision.

22. A marker luminaire as set forth in claim 21, the housing further comprising:

an external button for actuating the momentary switch; and an optical pathway between the light emitting diode and the exterior of the housing.

23. A marker luminaire as set forth in claim 20, the housing further comprising:

an upright translucent tube; and a stake for placement into ground for supporting the upright translucent tube.

24. A marker luminaire as set forth in claim 20, the light transmitting element including a generally light diffusing panel bearing relatively opaque, intelligible symbols.

25. A marker luminaire as set forth in claim 16, further comprising a pull chain extending from the housing.

26. A marker luminaire as set forth in claim 16, the light transmitting element including a generally light diffusing panel bearing relatively opaque, intelligible symbols.

27. A lamp comprising:

a housing;

a battery located in the housing;

a light emitting diode in the housing, the light emitting diode being of a type exhibiting high efficiency in light generation across a substantial drive current operating range and with increasing intensity as drive current increases, including light emission levels above a threshold of darkness adapted human vision and below a threshold of useful photopic vision at a threshold current;

a light scattering element optically coupled to the light emitting diode for transmitting and scattering light from the light emitting diode outside the housing; and diode drive circuitry connected to the battery to draw power therefrom and further connected to the light emitting diode to deliver drive currents to the light emitting diode sufficient to illuminate the light scattering element above the threshold of darkness adapted human vision but below the threshold of useful photopic vision.

28. A lamp as set forth in claim 27, wherein the light emitting diode emits broad spectrum light.

29. A lamp as set forth in claim 28, the diode drive circuitry further comprising:

a light sensitive element for reducing the level of the drive current to a negligible level in response to increasing ambient light; and an optical opening through the housing allowing ambient light to reach the light sensitive element.

30. A lamp as set forth in claim 27, further comprising a short range radio transmitter.

31. A lamp as set forth in claim 30, wherein the short range radio transmitter is coupled to the energization circuit to draw current through the light emitting diode.

32. A lamp as set forth in claim 31, wherein the light emitting diode emits broad spectrum light.

33. A luminaire comprising:

a housing;

a light scattering illumination source including a light emitting element for emitting light at a threshold current at an intensity level visible to a human eye adapted for light intensity levels below those required for photopic vision, the light scattering illumination source being mounted with respect to the housing to mark the location of the housing, when illuminated, over a wide viewing angle; and an electrical energization circuit supplying the threshold current to the light emitting element of the light scattering illumination source.

34. A luminaire as set forth in claim 33, further comprising:

a radio frequency transmitter coupled for energization to the electrical energization circuit.

35. A luminaire as set forth in claim 34, the light emitting element further comprising a light emitting diode positioned in the housing and a light scattering element optically coupled to the light emitting diode.

36. A luminaire as set forth in claim 35, the light emitting diode being a broad spectrum light emitting diode.

* * * * *